US010231592B1

(12) United States Patent
Ebrahimi Afrouzi

(10) Patent No.: US 10,231,592 B1
(45) Date of Patent: Mar. 19, 2019

(54) ROBOTIC FLOOR CLEANING DEVICE

(71) Applicant: Ali Ebrahimi Afrouzi, San Jose, CA (US)

(72) Inventor: Ali Ebrahimi Afrouzi, San Jose, CA (US)

(73) Assignee: AI Incorporated, Toronto (CA)

( * ) Notice: Subject to any disclaimer, the term of this patent is extended or adjusted under 35 U.S.C. 154(b) by 0 days.

(21) Appl. No.: 15/432,722

(22) Filed: Feb. 14, 2017

Related U.S. Application Data

(60) Provisional application No. 62/302,244, filed on Mar. 2, 2016.

(51) Int. Cl.
*A47L 13/22* (2006.01)
*A47L 11/40* (2006.01)
*A47L 11/28* (2006.01)

(52) U.S. Cl.
CPC ..... *A47L 11/4086* (2013.01); *A47L 11/28* (2013.01); *A47L 11/4011* (2013.01); *A47L 11/4066* (2013.01); *A47L 11/4072* (2013.01); *A47L 11/4083* (2013.01); *A47L 13/225* (2013.01); *A47L 2201/00* (2013.01)

(58) Field of Classification Search
CPC ..... A47L 13/225; A47L 11/4086; A47L 11/4066; A47L 11/4011; A47L 11/28; A47L 11/4083; A47L 2201/00; A47L 11/29; A47L 13/22
USPC ..... 15/320
IPC ..... A47L 11/29,13/22
See application file for complete search history.

(56) References Cited

U.S. PATENT DOCUMENTS 5,464,572 A * 11/1995 Bonzi ..... B05B 17/0615 250/324
5,502,872 A 4/1996 Chae et al.
6,640,383 B2 11/2003 Tsen
7,346,428 B1 3/2008 Huffman et al.
7,389,156 B2 6/2008 Ziegler et al.
8,392,021 B2 3/2013 Konandreas et al.
8,961,695 B2 2/2015 Romanov et al.
9,167,947 B2 10/2015 Dooley et al.
2003/0169588 A1* 9/2003 Kohn ..... F21V 33/0088 362/101
2004/0022675 A1* 2/2004 An ..... A61L 9/02 422/29
2004/0108604 A1* 6/2004 Pan ..... F24F 6/00 261/26
2006/0185690 A1* 8/2006 Song ..... A47L 11/34 134/21

FOREIGN PATENT DOCUMENTS

CN 102342791 * 2/2012

* cited by examiner

*Primary Examiner* — David Redding
(74) *Attorney, Agent, or Firm* — STLG ip Law Firm; Soody Tronson

(57) ABSTRACT

A robotic floor cleaning device that contains a cleaning fluid reservoir to store cleaning fluid and uses ultrasonic oscillators to vaporize the cleaning fluid. Vapor is delivered via nozzles to a work surface to remove debris therefrom.

7 Claims, 1 Drawing Sheet

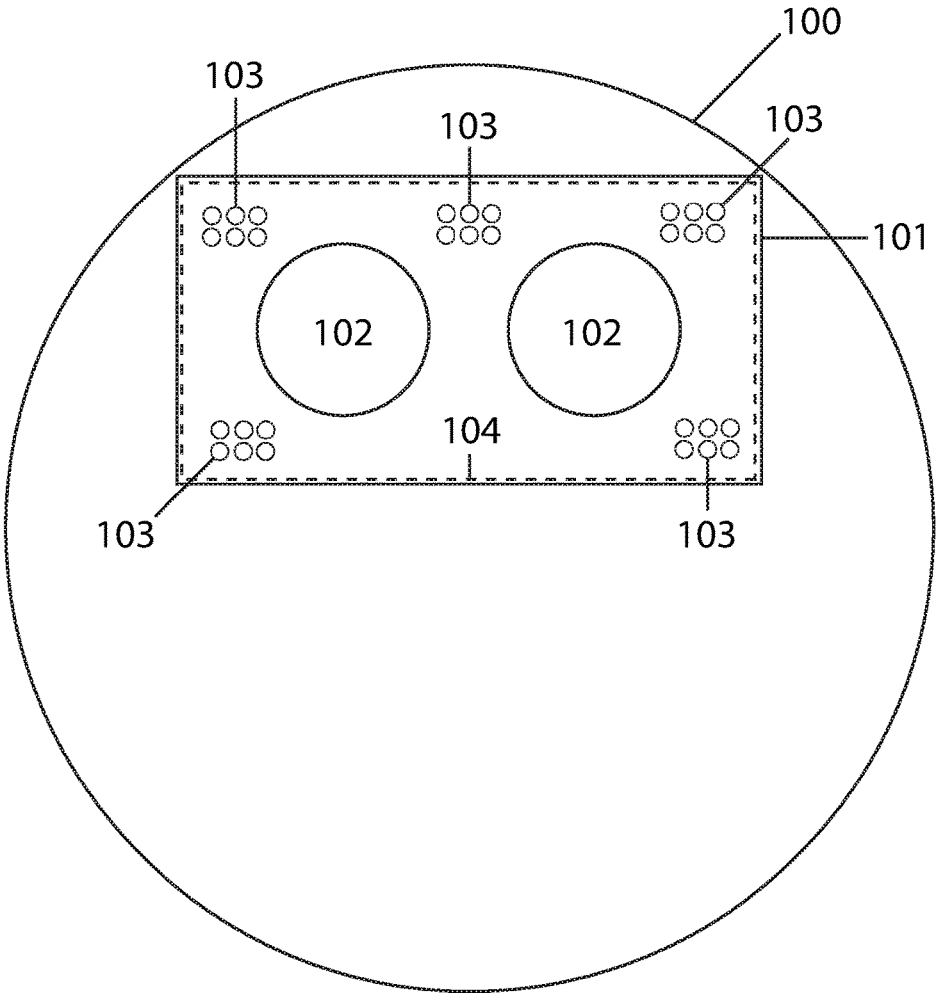
100
103
103
103
101
102
102
104
103
103

ROBOTIC FLOOR CLEANING DEVICE

CROSS-REFERENCE TO RELATED APPLICATIONS

This application claims the benefit of the provisional patent application Ser. No. 62/302,244 filed Mar. 2, 2016 by the present inventor.

FIELD OF INVENTION

This invention relates to robotic floor cleaning devices.

BACKGROUND

Mobile robotic devices are being used with increasing frequency to maintain clean floors in residential and commercial settings. For some flooring types, it may be beneficial to clean the floors with liquid. Robotic mopping devices have been used in prior art to carry out this task. Robotic mopping devices usually store water or cleaning fluid in a tank and disperse this fluid onto the work surface during work and use a tool to wipe or scrub the work surface thereafter. However, it may be more effective to clean a surface with steam. Heat from steam can help loosen debris particles from flooring surfaces. A need exists for a method to employ steam cleaning in robotic floor cleaning systems.

SUMMARY

It is a goal of the present invention to provide a robotic floor cleaning device that disperses steam onto work surfaces to facilitate cleaning.

The aforementioned goal is achieved through a robotic floor cleaning device with a fluid reservoir in which cleaning fluid is stored. Ultrasonic oscillators or other like means are used to vaporize some of the fluid from the fluid reservoir and nozzles or other like means deliver the vaporized fluid to an area for receiving fluid, which may be a work surface or a cleaning pad or cloth that will be rubbed on a work surface.

BRIEF DESCRIPTION OF DRAWINGS

FIG. 1 illustrates an overhead view of the underside of a mobile robotic floor cleaning device embodying features of the present invention.

DETAILED DESCRIPTION OF THE INVENTION

The present invention proposes a robotic floor cleaning device with a steam cleaning system.

Referring to FIG. 1, an overhead view of the underside of a robotic floor cleaning device 100 is illustrated. A reservoir 101 is positioned within the robotic floor cleaning device. Ultrasonic oscillators 102 are connected to the reservoir and vaporize the water to produce steam. (Other means for vaporizing water, such as heating systems, are well known and may be used in place of ultrasonic oscillators without departing from the scope of the invention.) Nozzles 103 deliver the steam to an area to receive steam. In some embodiments, an area to receive steam might be the surface or floor that the robotic floor cleaning device is driving and working on. In some embodiments, a mopping cloth 104 disposed under the nozzles to facilitate mopping or wiping of a work surface.

In some embodiments, a mopping cloth is removably attached, for example by Velcro, to the main body of the robotic floor cleaning device so that it may be removed and washed by a user after it has become soiled.

In some embodiments, the nozzles continuously deliver a substantially constant flow of steam to the mopping cloth.

In some embodiments, the nozzles periodically deliver predetermined quantities of steam to the cloth.

I claim:

1. A robotic floor cleaning device comprising:
- a chassis including a set of wheels;
- a motor to drive the wheels, the motor electrically coupled to a battery disposed in the chassis;
- a control unit to provide at least one movement path to the robotic floor cleaning device;
- a fluid reservoir to store a cleaning fluid;
- one or more ultrasonic oscillators electrically coupled to the battery to vaporize fluid in the fluid reservoir; and,
- a plurality of nozzle sets dispersed across an underside of the robotic floor cleaning device and a mopping cloth positioned below the plurality of nozzle sets to receive the vaporized fluid across a top surface of the mopping cloth wherein a bottom surface of the mopping cloth wipes the work surface.

2. The robotic floor cleaning device of claim 1 wherein said mopping cloth is removably attached to the chassis.

3. The robotic floor cleaning device of claim 1 wherein said ultrasonic oscillators operate continuously at a constant rate.

4. The robotic floor cleaning device of claim 1 wherein said ultrasonic oscillators turn on at intervals.

5. A robotic floor cleaning device comprising:
- a chassis including a set of wheels;
- a motor to drive the wheels;
- a control unit to provide at least one movement path to the robotic floor cleaning device;
- a fluid reservoir to store a cleaning fluid;
- one or more ultrasonic oscillators for vaporizing cleaning fluid from the fluid reservoir;
- a plurality of nozzle sets dispersed across an underside of the robotic floor cleaning device that direct vaporized fluid to a work surface; and
- a mopping cloth positioned under the plurality of nozzle sets to receive the vaporized fluid across a top surface of the mopping cloth wherein a bottom surface of the mopping cloth wipes the work surface.

6. The robotic floor cleaning device of claim 5 wherein said oscillators for vaporizing the cleaning fluid from the fluid reservoir is activated continuously at a constant rate.

7. The robotic floor cleaning device of claim 5 wherein said oscillators for vaporizing the cleaning fluid from the fluid reservoir is activated at predetermined intervals.

* * * * *